US008953830B2

(12) United States Patent
Skramstad

(10) Patent No.: US 8,953,830 B2
(45) Date of Patent: Feb. 10, 2015

(54) HORN LOUDSPEAKER AND A SOUND SOURCE

(76) Inventor: Rune Skramstad, Drammen (NO)

( * ) Notice: Subject to any disclaimer, the term of this patent is extended or adjusted under 35 U.S.C. 154(b) by 792 days.

(21) Appl. No.: 12/377,986

(22) PCT Filed: Aug. 21, 2007

(86) PCT No.: PCT/NO2007/000292

§ 371 (c)(1),
(2), (4) Date: Jul. 16, 2010

(87) PCT Pub. No.: WO2008/023991

PCT Pub. Date: Feb. 28, 2008

(65) Prior Publication Data

US 2010/0272301 A1 Oct. 28, 2010

(30) Foreign Application Priority Data

Aug. 21, 2006 (NO) ..... 20063735

(51) Int. Cl.
*H04R 1/20* (2006.01)
*H04R 1/30* (2006.01)
(Continued)

(52) U.S. Cl.
CPC ..... *H04R 1/30* (2013.01); *H04R 1/403* (2013.01); *H04R 27/00* (2013.01)
USPC ..... 381/340; 381/339; 381/341; 381/342; 381/345; 381/346; 381/347; 381/348; 181/152; 181/159; 181/198

(58) Field of Classification Search
None
See application file for complete search history.

(56) References Cited

U.S. PATENT DOCUMENTS 3,238,056 A * 3/1966 Pall et al. ..... 428/338
3,666,041 A 5/1972 Engelhardt
4,104,170 A * 8/1978 Nedza ..... 210/487
(Continued)

FOREIGN PATENT DOCUMENTS

WO WO 2006/088380 A1 8/2006

OTHER PUBLICATIONS

Peter W. Tappan, "Loudspeaker Enclosure Walls" Audio Engineering Society, Convention Preprint, Oct. 9, 1989, pp. 1-16.
(Continued)

*Primary Examiner* — Duc Nguyen
*Assistant Examiner* — Taunya McCarty
(74) *Attorney, Agent, or Firm* — Knobbe, Martens, Olson & Bear LLP

(57) ABSTRACT

A horn loudspeaker, in particular for reproducing bass sound in public address systems, in which the horn (23) is mounted directly to the driver element (21) without any intervening compression chamber. The back side of the driver element (21) is covered by a back chamber (24) designed with walls of a semi-permeable material. The walls may be perforated or made of a "leaky" material such as cell foam with open structure, or a fibrous material. The "leaky" back chamber will prevent the build up of high pressures in the back chamber at large cone excursions. The horn loudspeaker is suitable for stacking in groups of two or more, so as to produce a sound source scalable for reproducing any frequency range heard by humans in public address systems or hi-fi systems. Due to the back chamber design, the horn loudspeaker, for high frequencies especially in conical horn shaped versions, can be stacked close together. Thus, a sound source including a number of such closely stacked loudspeakers can provide a homogeneous sound field covering a wide area even at high audio frequencies.

18 Claims, 4 Drawing Sheets

(51) Int. Cl.
*H04R 1/40* (2006.01)
*H04R 27/00* (2006.01)

(56) References Cited

U.S. PATENT DOCUMENTS

| | | | | |
|---|---|---|---|---|
| 4,138,594 | A * | 2/1979 | Klipsch | 381/335 |
| 4,146,744 | A * | 3/1979 | Veranth | 381/89 |
| 4,454,927 | A * | 6/1984 | Seebinger | 181/152 |
| 6,016,353 | A | 1/2000 | Gunness | |
| 6,279,678 | B1 * | 8/2001 | Tracy | 181/144 |
| 6,376,396 | B1 * | 4/2002 | Thorn et al. | 442/136 |
| 6,932,187 | B2 * | 8/2005 | Banter et al. | 181/149 |
| 2003/0228027 | A1 * | 12/2003 | Czerwinski | 381/342 |
| 2007/0284183 | A1 * | 12/2007 | Whitaker | 181/150 |

OTHER PUBLICATIONS

T. Giffard, "Horn Loudspeaker" Elektor Electronics, Tunbridge Wells, GB, May 1, 1990, vol. 16, No. 178, pp. 20-23.

International Search Report dated Dec. 21, 2007 for PCT/NO2007/000292.

Wavefront Touring Series W8C/W8CS/WSX/W8CM/W8CT User's Guide, Martin Audio, London, 2007.

J. Dinsdale: "Horn loudspeaker design". Reprinted from Wireless World, Mar. 1974, 6 pages.

* cited by examiner

HORN LOUDSPEAKER AND A SOUND SOURCE

CROSS REFERENCE TO RELATED APPLICATION

This application claims the benefit and priority to and is a U.S. National Phase of International Application Number PCT/NO2007/000292, filed on Aug. 21, 2007, designating the United States Our File No.: America and published in the English language, which is an International Application of and claims the benefit of priority to Norwegian Patent Application No. 20063735, filed Aug. 21, 2006. The disclosures of the above-referenced applications are hereby expressly incorporated by reference in their entireties.

FIELD OF THE INVENTION

The present invention relates to horn loaded loudspeakers, such as horn loudspeakers suitable for low distortion sound reproduction at high sound pressure levels. Further, the invention relates to a sound source including a multitude of horn loudspeakers.

BACKGROUND OF THE INVENTION

Horn loudspeakers consist of a loudspeaker element or driver with a horn funnel placed in front of the element. The horn serves to couple acoustic energy emitted by the element into the surrounding air, by transforming the acoustic impedance of the element to the impedance of the space. The advantages of the horn speaker compared with other speaker designs, such as bass reflex, band pass and closed systems, are a high sensitivity and a good transient response due to the good coupling properties. In addition the well controlled spreading of the sound may be exploited to avoid echo and feedback in public address systems. However, a horn speaker is a complicated construction, and it is well known that many horns designs have an inferior sound quality, with a characteristic horn sound.

FIG. 1 shows the principle followed by most horn speaker designs, with a compression chamber in front of an element leading into a horn funnel with an exponential expansion. The back of the element is closed by a small closed chamber.

The air in the closed back chamber will expand when the diaphragm (or cone) moves outward and become compressed when the cone moves inward. Thus, the air will act as an elastic spring on the cone. This is governed by the gas law $pV^{\gamma}=C$ where $\gamma$ is the adiabatic exponent which is about 1.4 for air, p is pressure, V is volume, and C is a constant. This relates to adiabatic conditions (no heat transfer).

The loudspeaker affects the volume by pushing in and out and the maximum volume change is $Vd=Sd\ Xmax$ where Sd is the effective cone area and Xmax is the maximum displacement of the cone. Thus the loudspeaker affects the volume, but we sense the resulting pressure variation. The gas law shows that there is a nonlinear relationship between volume and pressure.

The gas law can be linearized for small volume changes so that there is an approximate linear relationship between cone displacement and the corresponding pressure change. This is given by the compliance or inverse stiffness which is the volume change over the pressure change: $C=\Delta V/\Delta p$. Its value can be found by differentiating the gas law at the value of the surrounding pressure (p0=1 atmosphere). This is the assumption of linear acoustics. In this case the air acts as a linear spring with a constant compliance.

However, for the large volume changes that can occur in horn loudspeakers at high drive levels, the nonlinearity of the pressure-volume relationship becomes important and one enters the realm of nonlinear acoustics. In this case the value of the compliance will change for positive and negative cone excursions. This is mainly an effect that affects the lower bass as cone excursion increases with lower frequency for the same sound pressure.

The compression chamber in front of the driver has as its object to compensate for this nonlinear stiffness/compliance. However, it will only work effectively over a limited range of sound pressures, and the resultant coloring of the sound is responsible for the distinct horn sound (compression and honking) disliked by many audio enthusiasts. Honking may also arise if the horn is too short.

It has been proposed to replace the closed chamber with another horn at the back that is identical to the normal front mounted horn. It is evident that such a solution will be unrealistic in most, cases due to the large volume needed. And most horn speakers are very voluminous already. Others have tried to circumvent the problem by eliminating the closed chamber altogether (Bassmaxx) and let the driver work with an open back. Then the cone is easily loaded too little, resulting in less control of its movement, and too large cone excursions at low frequencies.

However, this solution is an improvement over speakers with closed chambers, as the compliance conditions will change less with increasing sound level.

In the mid/treble range horn speakers have very narrow direction diagrams, which may be a problem in public address settings. One solution is to stack several speakers, the sub-speakers pointing in different directions. However, such an arrangement easily leads to interference between the sub-speakers, with the direction diagram breaking up into several lobes (grating lobes). This is due to the large distance between individual sub-speakers and the curved form of the wavefront of the sound leaving each sub-speaker. The sub-speakers can not be stacked as tightly as desired due to the large size of the closed chamber at the rear of each sub-speaker. Normally, the horn walls and box walls have to be separate constructions because of the too large back chamber, and this further leads to even larger distances between sub-speakers.

SUMMARY OF THE INVENTION

It is an object of the present invention to provide a loudspeaker and sound source with improved sound quality over prior art systems, and which is compact.

The invention provides a loudspeaker including a driver element with a diaphragm, the driver element being mounted in an enclosure, said enclosure forming a horn mounted directly in front of said driver element, while a back chamber covers the driver element on its back side. The back chamber is characteristic in that it has at least a wall or element of a semi-permeable material preventing the build up of high air pressures in the back chamber at large diaphragm excursions.

Such loudspeaker is capable of producing high sound pressures with a minimum of distortion, since the diaphragm of the driver element will perform linear movements compared to prior art designs, since even with a back chamber of small dimensions, it is possible to ensure that the diaphragm will move substantially in a linear motion thus preventing high amounts of non-linear distortion and compression effects at high acoustic outputs.

Further, the loudspeaker can be produced compact since the back chamber can be made small in size, and since the driver element is mounted directly to the horn with no expansion chamber, the total required amount of space for a given size of horn is relaxed compared to prior art designs. Thus, the loudspeaker according to the invention is suited e.g. for mobile high power bass loudspeakers.

Still further, such horn loudspeaker is advantageous since it is possible to use driver elements capable of producing larger diaphragm excursions compared to normal drivers for horn loudspeakers which typically have drivers with very stiff suspension systems with only small maximum possible excursions.

Still further, even though the back chamber with a semi-permeable wall prevents build up of high pressures, it is still possible that the back chamber can provide a substantial sound insulation effect such that it is ensured that the acoustic power radiated in a direction opposite the horn opening is considerably reduced. Thus, in e.g. PA systems, sound radiated backwards towards the stage is considerably attenuated such that acoustic feedback to stage microphones and disturbing sound for the stage performers is reduced.

Even further, the compact size of the back chamber made possible with the present invention, enables the possibility of providing midrange and/or treble loudspeaker embodiments suitable for stacking close together. Thus, two, three or more units stacked together so as to form a sound source capable of covering a large horizontal angle with a homogeneous sound field without severe "dips" even up to a rather high frequencies, e.g. above 10 kHz. Hereby it is possible to better cover e.g. a large concert area. This is possible due to the small size of the back chamber, and especially in combination with loudspeakers having conically shaped horns, it is possible to provide loudspeakers that can be placed very close to each other such that sound radiating from their horn openings produce a resulting sound wave without unwanted negative interference effects that could result in a non-spherical radiation pattern. Furthermore, since negative acoustic interference between the individual loudspeakers can be avoided, a high resulting electrical to acoustic conversion efficiency is achieved.

It is to be understood that the phrase "wall" regarding the back chamber is not limiting with regard to the basic function of the inventive loudspeaker, namely that the back chamber has at least a substantial semi-permeable portion or element preventing the build up of high air pressures in the back chamber at large diaphragm excursions. Thus, in some embodiments the entire back chamber can be made with one or several walls of one or more types of semi-permeable material, or in other embodiments a part of the back chamber has a non-permeable material while another part of the back chamber is made of semi-permeable material with dimension large enough to prevent build up of high air pressures at large diaphragm excursions. In a simple embodiment the back chamber is made in one piece of semi-permeable material.

By "semi-permeable material" is understood a material which allows air at a static pressure to pass but still provides a substantial acoustic resistance, preferably a material providing an acoustic resistance between 50 and 5000 $Ns/m^3$, preferably between 150 and 3500 $NS/m^3$, such as between 500 and 2000 $NS/m^3$.

In some embodiments, acoustic damping material as known in the art, e.g. mineral wool etc. is positioned within the back chamber.

It may be preferred to acoustically design the back chamber such that it substantially matches the acoustic impedance of the horn, at least in a limited frequency range where the loudspeaker is desired to have its most optimal performance.

Preferred embodiments are defined in the appended dependent claims.

BRIEF DESCRIPTION OF THE DRAWINGS

The invention will now be described in detail in reference to the appended drawings, in which.

DETAILED DESCRIPTION OF THE INVENTION

Figure 1:
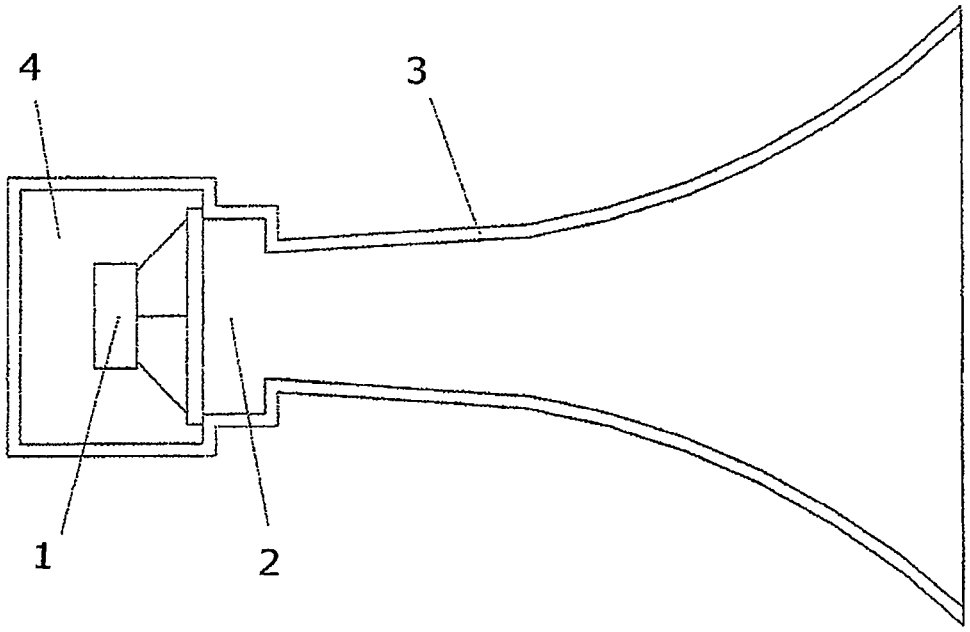
Prior art Fig. 1
FIG. 1 is illustrating the principle used by conventional horn loaded speakers.

FIG. 1 illustrates the basic design of most current horn speaker designs of prior art. A driver element 1 is mounted facing a compression chamber 2. The compression chamber 2 is opening into a horn 3 that conducts the sound into the surrounding space. The horn is expanding with an exponential function, which is the most common design nowadays. In bass speakers, the horn will be folded into a more compact unit in order to conserve space. A small closed chamber 4 is mounted at the back side of the driver element 1.

Figure 2:
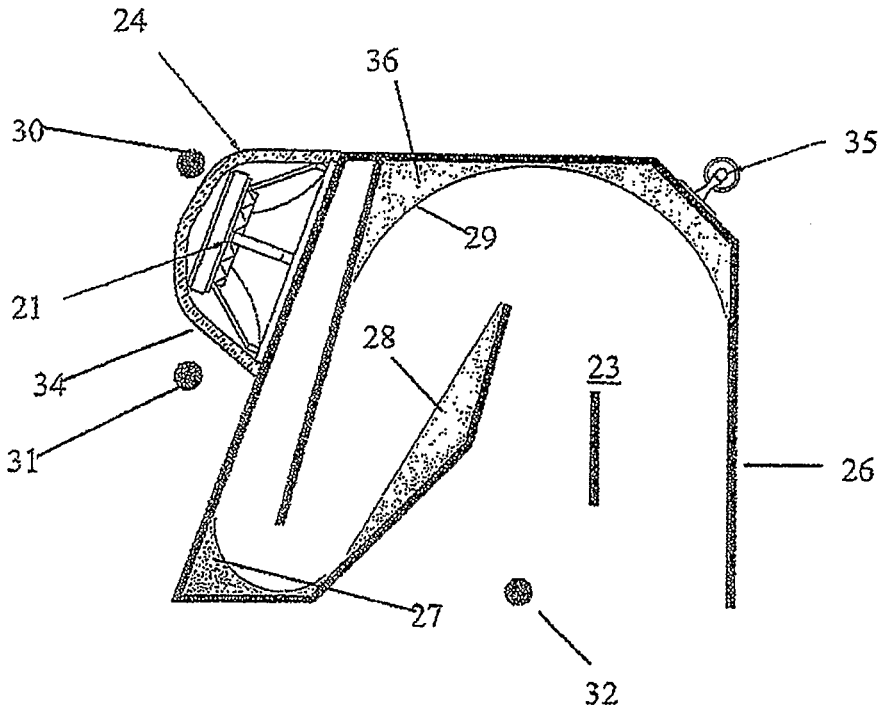
FIG. 2 is a sectional view through an embodiment of the inventive horn speaker.

As mentioned in the introduction, this speaker construction has a number of disadvantages which are remedied in the present inventive construction depicted in FIG. 2. In this construction, the driver element 21 is mounted facing a horn 23. No compression chamber is present, and thus a more compact interface to the horn 23 is provided.

Behind the driver 21 there is a small "leaky" back chamber 24 with semi-permeable walls. The walls may be made from a material with small perforations, the number of perforations per unit area and their size determining its acoustic properties, or from a continuous foam or fibrous similar properties. The foam in question may be cell foam with open structure. The leakiness of a fibrous material is determined by its density and thickness. The use of such a material will prevent the build up of pressure in the back chamber 24. Acoustically, the material therefore ensures that the cone meets almost constant compliance regardless of displacement.

Two additional examples of semi-permeable materials to be used as wall or walls in the back chamber 24 are: 1) filters (such as for filtration of gases or liquids) formed by thin sheets (<1 mm thick) of a non-woven, sintered, stainless steel fibre matrix for filtration levels from 5 to 50 micron, 2) Feltmetal® Acoustic Media which is an engineered, porous material made of sintered metal fibres with diameters between 6 and 150 microns. Fibre size, porosity and thickness combine to control the desired flow.

Still, other types of material may be used as the semi-permeable material if providing the acoustically semi-permeable effect. Further, layers of two or more different types of material may be used.

The conformity between driver and horn may be measured by exciting the driver with a signal from an audio generator and observing the cone excursion. With a back chamber with the correct acoustical properties, the compliance will be identical for positive and negative excursions, i.e. the loudspeaker will operate in the linear regime for as high cone excursions as possible. Then, the cone will move symmetrically around the resting position, thus resulting in lower distortion at high sound levels. The cone excursion may be observed with laser interferometry, or any other suitably method.

The back chamber may be matched to the horn at a specific frequency. Alternatively, the matching may be measured at a number of frequencies, and the acoustical properties of the wall material, i.e. its density, varied until a mean error is achieved. Outside the active bandwidth, any mismatch will be of no consequence.

The driver is delivering the sound directly into the horn, without any interfering pressure chamber. This is made possible by the symmetric loading of the driver and ensures low distortion even at high sound pressure levels.

Physically, the loudspeaker enclosure is made with walls and partitions 26 of wooden panels, chipboard or plywood. The walls/partitions 26 are fastened to end walls (not shown). The shape defined by the wooden panels is modified by adding flexible plates 27, 28, 29, or pre formed plates which have been through a rolling mill. The plates are made from a metal, such as aluminium, a plastic or fibre reinforced plastic. The plates may form bends in the enclosure, such as the parts 27, 29, and are fastened to the wooden parts with any suitable fastener, such as screws, nails or glue. The voids between the wooden parts and the plates are filled with foam 36, such as hardening expansion foam of polyethylene (PE) or polyurethane (PU). This particular construction of wood, flexible or pre formed plates and foam are light in weight, mechanically strong and acoustically dead.

The enclosure is in addition reinforced with aluminium tubes 30, 31, 32 between the end walls. The tube 32 is placed at the mouth of the horn, in which there is a large span with no wall or partition plate, and where vibrations may easily occur. The tubes 30, 31 serve as handles during transport and give a measure of protection for the driver 21. The chamber 24 is also covered by a protective perforated plate 34, of a metal such as aluminium, or plastic. The plate will affect the acoustical properties of the chamber, which must be taken into account when fitting the chamber 24 to the horn. Lastly, the enclosure may be equipped with castors 35 making it possibly to move the speaker single-handled.

Figure 3:
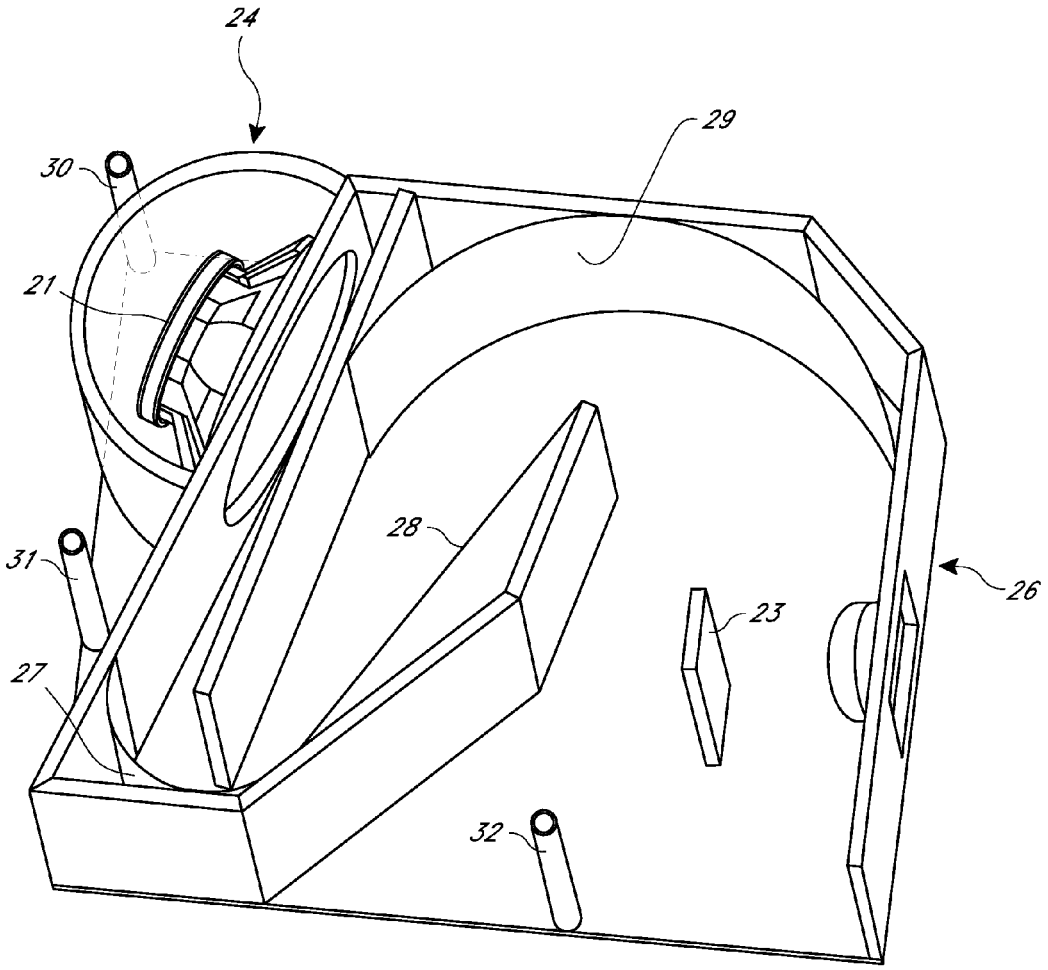
FIG. 3 is a perspective view of the inventive speaker with an end wall removed.

FIG. 3 has been added to give an impression of the finished enclosure. One end wall has been removed to show the interior of the enclosure.

Figure 4:
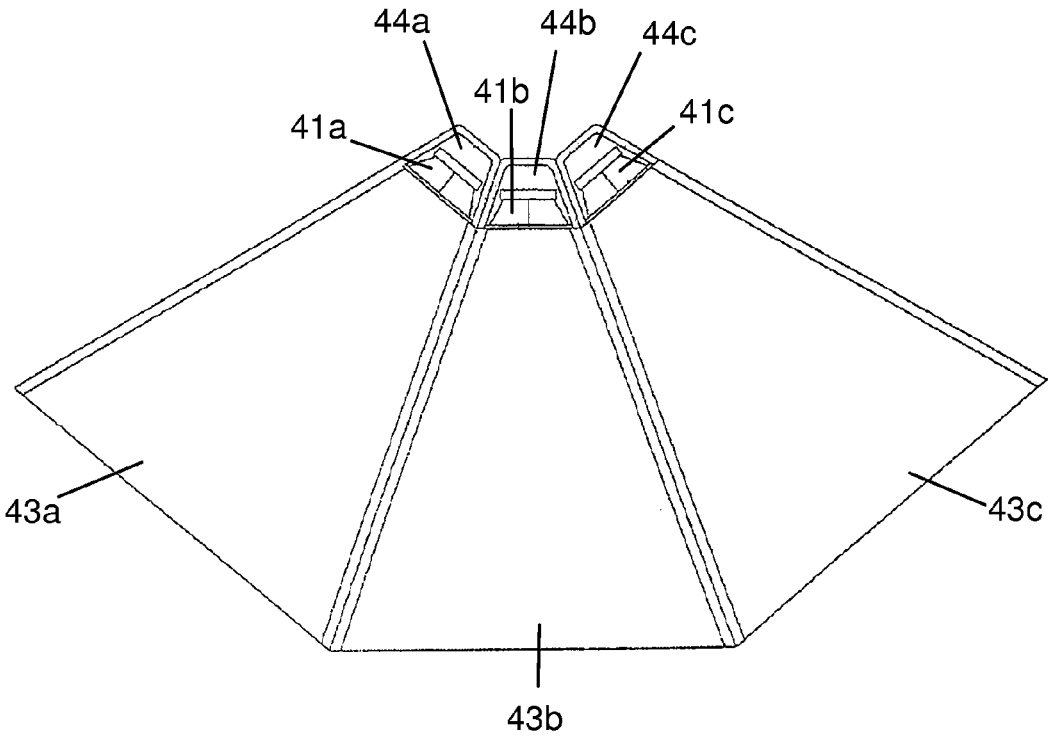
FIG. 4 shows a treble sound source consisting of a number of stacked horn speakers.

FIG. 4 shows a part of a sound source with omni-directional, or at least cylindrical sound radiation. The sound source can serve as midrange, treble or combined midrange and treble sound source, and it comprises a multitude of stacked sub-speakers. At treble frequencies speakers are designed with straight horns, as the small dimensions of the funnel make this feasible. Thus, the design in FIG. 4 includes a number of sub-speakers, each with a straight conical horn 43*a-c*. The opening angle of the conical horns in the illustrated embodiment is approximately 40° for each sub-speaker, but in other embodiments the opening angle may be in the range 5° to 120°. The opening angle preferably should be designed so that the highest frequency to be reproduced will fill the entire horn without beaming. Conical horns have been chosen over other designs as this design gives less distortion, although at the cost of a slightly lower efficiency. Behind each driver element 41*a-c* there is mounted a small resistance chamber 44*a-c*. As explained above, this resistance chamber 44*a-c*, as well as the avoidance of a compression chamber in 1 front of the driver 41*a-c*, means an improvement in sound quality at high sound pressure levels. The small size of the resistance chamber means that the sub-speakers may be stacked tightly; thus preventing the formation of grating lobes. Another effect of this design is that the front of the sound waves at the mouth of the horn is very flat. Then, the sound waves from adjacent sub-speakers will superimpose with nearly no destructive interference. Altogether, this means a very clean sound pattern from this source and a more uniform pattern at higher frequencies (½-2 octaves higher) than prior art stackable horn systems.

The compact design of the horn loudspeakers allowing closely stacking can especially be obtained in embodiments where walls forming sides of the conical horn also serves as surrounding housing or box serving to protect the loudspeaker, such as it is the case with the embodiment in FIG. 4. Further, since the walls serve two purposes, namely constitute part of the horn as well as part of the housing, material is saved compared to forming the loudspeaker with a separate horn and a separate housing. Thus, such loudspeakers can be made very light weight, thereby facilitating its handling during installation.

The invention claimed is:

1. A loudspeaker comprising:

a driver having a driver element with a diaphragm;

a horn mounted directly to the front side of the driver without any intervening compression chamber, the horn having an acoustic resistance; and a back chamber enclosing the driver element on the back side of the driver, wherein the back chamber has at least a substantial semi-permeable portion that is made of a semi-permeable material for allowing air to flow through the semi-permeable portion and out of the back chamber which prevents the build-up of high air pressures in the back chamber at large diaphragm excursions, wherein the back chamber has an acoustic resistance that substantially matches the acoustic resistance of the horn within an active bandwidth of the horn.

2. The loudspeaker as claimed in claim 1, wherein the acoustic resistance is between 50 and 5000 $Ns/m^3$.

3. The loudspeaker as claimed in claim 1, wherein the acoustic resistance is between 150 and 3500 $Ns/m^3$.

4. The loudspeaker according to claim 1, wherein the back chamber has one or more semi-permeable walls.

5. The loudspeaker according to claim 1, wherein the acoustic resistance is between 500 and 2000 $Ns/m^3$.

6. The loudspeaker according to claim 1, including a portion of acoustic damping material positioned within the back chamber.

7. The loudspeaker according to claim 3, wherein a protective housing of perforated metal or plastic is covering said semi-permeable material.

8. The loudspeaker according to claim 1, wherein the horn has a substantially conical shape, or wherein the horn is folded.

9. A public address system comprising a plurality of loudspeakers according to claim 1, wherein said loudspeakers are stacked tightly together.

10. The public address system according to claim 9, wherein the horn of each of the loudspeakers has a substantially conical shape.

11. The public address system according to claim 10, wherein free air openings of the horns of the number of loudspeakers are positioned together so as to allow generation of a smooth acoustic wave pattern from the sound source.

12. The public address system according to claim 9, including two loudspeakers positioned together.

13. The public address system according to claim 12, including three loudspeakers positioned together.

14. The public address system according to claim 10, wherein the conical shape of the horns is described by an opening angle in the range 5° to 120°.

15. The public address system according to claims 9, wherein each of the loudspeakers includes a housing, and wherein at least one wall forming part of said housing also serves as a wall forming the horn.

16. The loudspeaker according to claim 1, wherein the semi-permeable material has a thickness of less than 1 mm.

17. The loudspeaker according to claim 1, wherein the semi-permeable material includes pores having a diameter between 6 and 150 microns.

18. The loudspeaker according to claim 1, wherein the semi-permeable material comprises a non-woven fiber matrix for filtration levels from 5 to 50 micron.

* * * * *